US008021213B2

(12) United States Patent
Chiang

(10) Patent No.: US 8,021,213 B2
(45) Date of Patent: Sep. 20, 2011

(54) ACRYLIC POLISHER

(76) Inventor: Chun-Hui Chiang, Yun-Lin Hsien (TW)

( * ) Notice: Subject to any disclaimer, the term of this patent is extended or adjusted under 35 U.S.C. 154(b) by 0 days.

(21) Appl. No.: 12/344,050

(22) Filed: Dec. 24, 2008

(65) Prior Publication Data

US 2010/0279590 A1 Nov. 4, 2010

(51) Int. Cl.
*B24B 25/00* (2006.01)

(52) U.S. Cl. ..... 451/319; 451/259; 451/44; 451/260; 451/267

(58) Field of Classification Search ..... 451/319, 451/259, 63, 162, 158, 282, 44, 260, 267
See application file for complete search history.

(56) References Cited

U.S. PATENT DOCUMENTS 6,390,900 B1 * 5/2002 Susnjara ..... 451/178
6,554,265 B2 * 4/2003 Andronica ..... 269/268
7,252,578 B2 * 8/2007 Yen ..... 451/178
2009/0264055 A1 * 10/2009 Wu et al. ..... 451/325
* cited by examiner

*Primary Examiner* — George Nguyen
(74) *Attorney, Agent, or Firm* — Wang Law Firm, Inc.; Li K. Wang

(57) ABSTRACT

An acrylic polisher includes: a base with two oppositely disposed sideboards with a notch on each of them and a disposition surface in between, a cutting blade set performing a cutting process along the edge of the disposition surface, a stopping board driven by a driving device to move up and downs with respect to the disposition surface. When the stopping board moves downward to the side of the disposition surface, a machining span is formed between the stopping board and the disposition surface. Therefore, as the stopping board lowers to the side of the base, the operator only needs to push an acrylic object toward the stopping board and can quickly obtain the required machining span. The notches on the sideboards of the base form an open space around the disposition surface. The length of the acrylic object is thus not restricted.

5 Claims, 9 Drawing Sheets

ACRYLIC POLISHER

BACKGROUND OF THE INVENTION

1. Field of Invention

The invention relates to an acrylic polisher and, in particular, to an acrylic polisher that can directly polish acrylic objects of larger sizes without additional cutting and machining. When machining larger acrylic objects in several steps, the invention can achieve high surface yields.

2. Related Art

The conventional acrylic polisher, as shown in FIG. 9, has a base 1. An acrylic object 2 is disposed on the base 1. One side of the base 1 has a polishing blade 3 moving along the edge of the base 1. The polishing blade 3 thus polishes a surface of the acrylic object 2 on the base 1.

However, one has to be manually adjusted the position of the acrylic object 2 on the base 1 in the conventional acrylic polisher before polishing. The surface 4 of the acrylic object 2 to be polished slightly protrudes from the end surface of the base 1. Afterwards, the user controls the distance between the acrylic object 2 and the polishing blade 3 by eyes, thereby determining the polishing depth of the polishing blade 3 on the acrylic object 2. However, the above-mentioned method of controlling the distance between the acrylic object 2 and the polishing blade 3 by eyes is not only time-consuming, but also has a larger errors in the distance and the level.

Besides, both sides of the base 1 in the conventional acrylic polisher are extended upward with a supporting board 5, respectively. A conveyor 6 is mounted on the two supporting boards 5 and has several pressing elements 7 for constraining the acrylic object 2 on the base 1. However, the two supporting boards 5 of the base 1 restrict the length of the acrylic object 2. If the length of the acrylic object 2 is longer than the distance between the two supporting boards 5, the acrylic object 2 has to be cut first in order for its length to fit between the two supporting boards 5. Only after that can the acrylic object 2 be disposed on the base 1 for polishing. Therefore, the conventional acrylic polisher cannot directly polish larger acrylic objects 2. Additional cutting does not only lower the efficiency, but also increases the production cost.

SUMMARY OF THE INVENTION

An objective of the invention is to provide an acrylic polisher that can effectively increase the precision in disposing an acrylic object and can directly polish acrylic objects of larger sizes without additional cutting.

Another objective of the invention is to provide an acrylic polisher that can achieve high surface yields when large acrylic objects have to be polished in several steps.

To achieve the above-mentioned objectives, the disclosed acrylic polisher includes: a base, a cutting blade set, a conveyor, and a stopping board.

The base has two oppositely disposed sideboards, between which is a disposition surface for disposing an acrylic object. Each of the opposite end surfaces of the two sideboards has a track. Each of the two sideboards has a notch. The notches are formed opposite to each other, so that the two sides of the disposition surface is an open space.

The cutting blade set is provided by the disposition surface of the base, along the edge thereof. It undergoes a cutting process between a starting point and an ending point.

The conveyor is disposed above the disposition surface. One side of it has several air-pressured cylinders, each of which drives a pressing element to press on the disposition surface.

Both sides of the stopping board are formed with a guiding track, respectively. The stopping board is embedded inside the tracks of the two sideboards. The stopping board is driven by a driving device to move up and downs along the tracks and relative to the disposition surface. When the stopping board moves downward to the side of the disposition surface, the end surface of the stopping board facing the disposition surface becomes a stopping surface. A predetermined machining span is formed between the stopping surface and the disposition surface.

BRIEF DESCRIPTION OF THE DRAWINGS

The invention will become more fully understood from the detailed description given herein below illustration only, and thus is not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
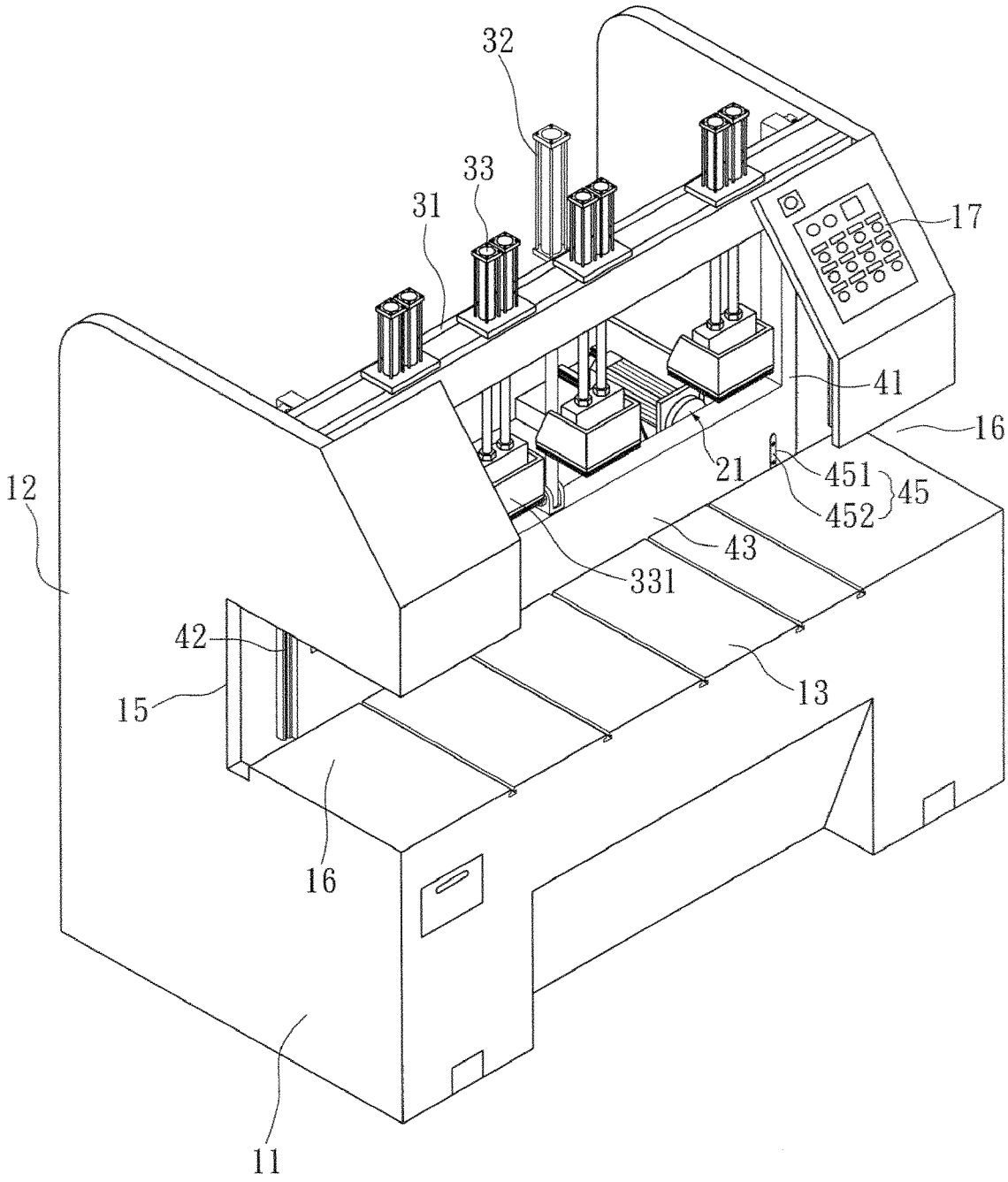
FIG. 1 is a three-dimensional view of the invention.
Figure 2:
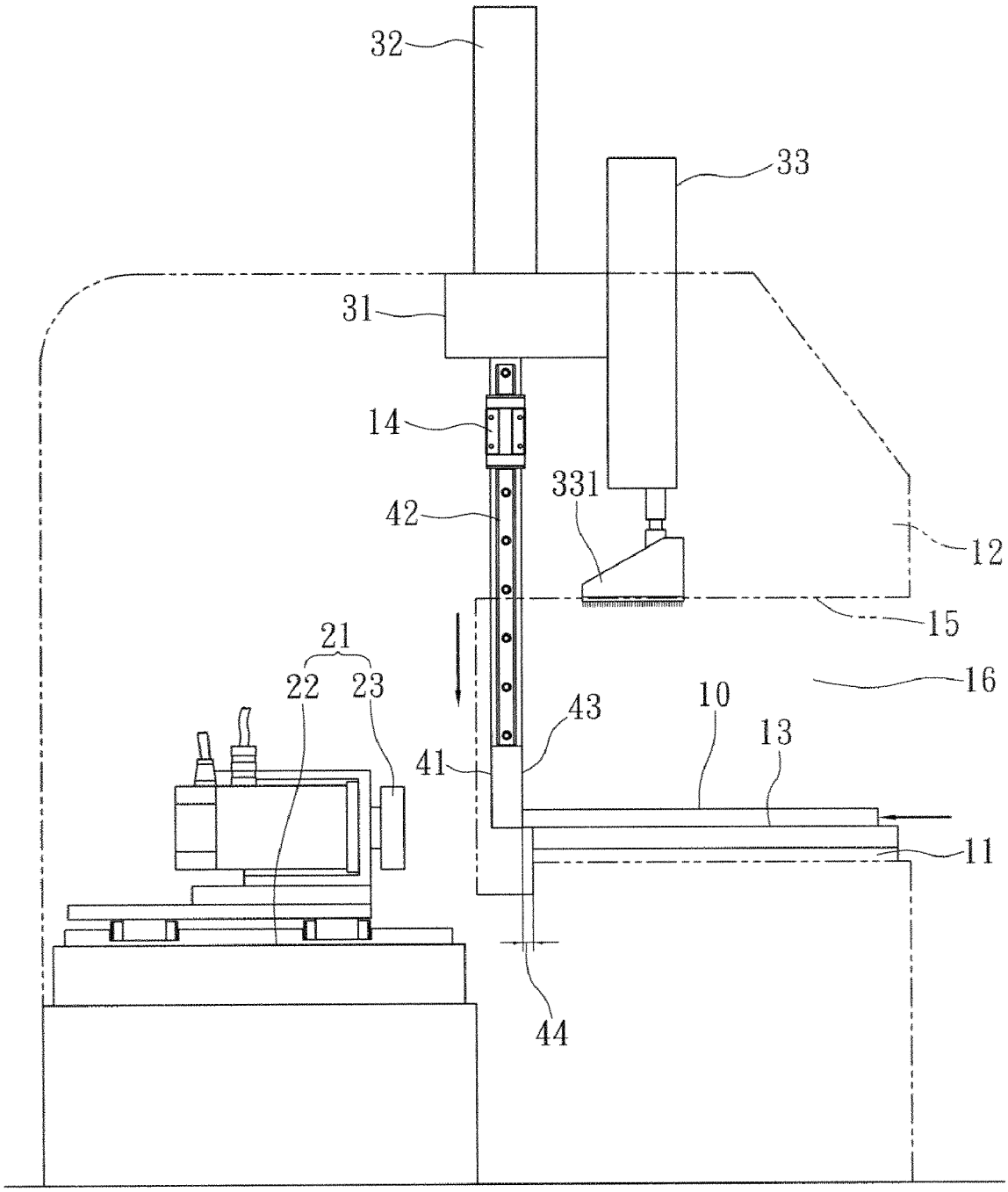
FIG. 2 shows the state of the invention in use, when the stopping board is lowering.
Figure 3:
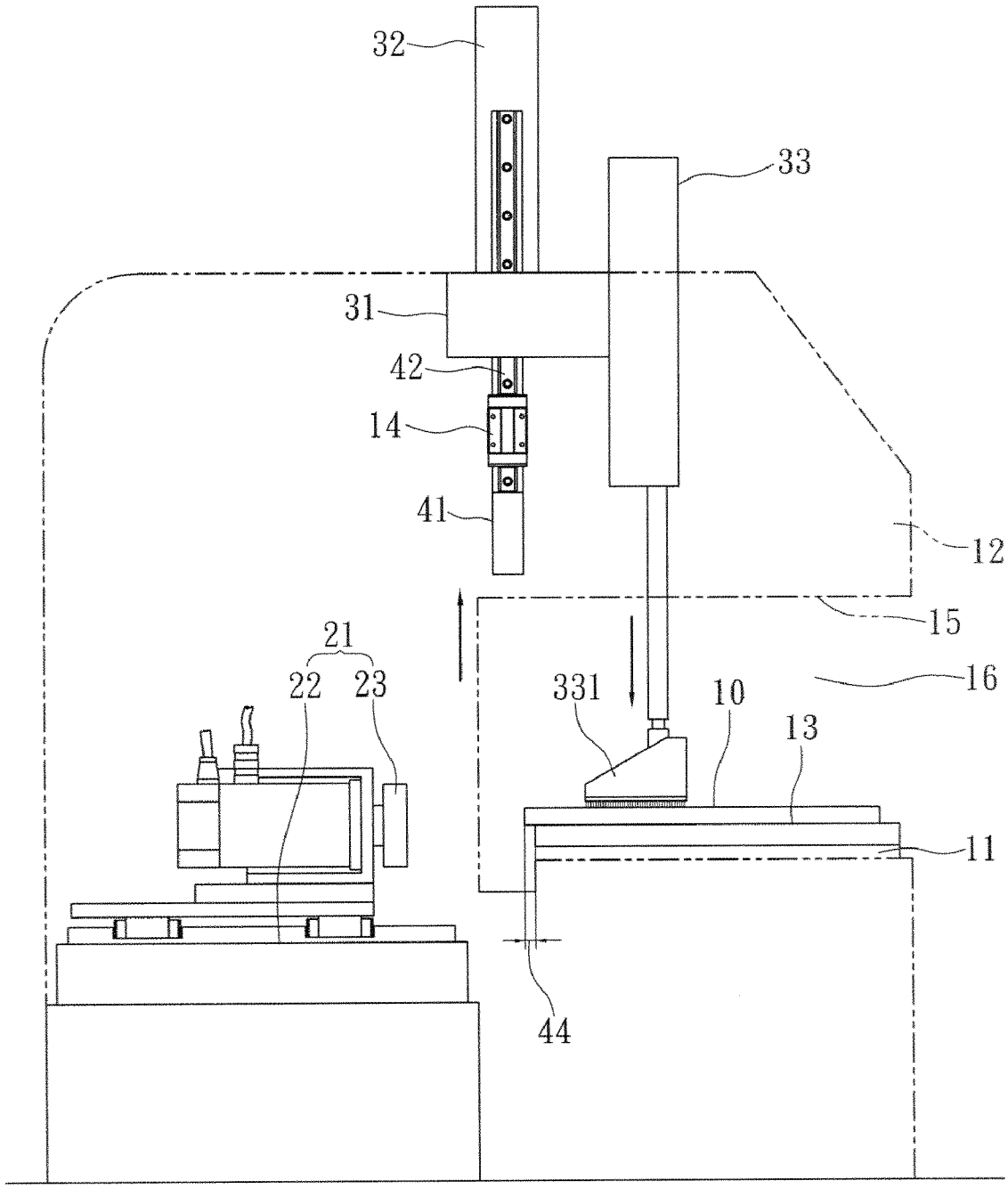
FIG. 3 shows the state of the invention in use, when the stopping board is rising and the pressing elements are lowering.

Please refer to FIGS. 1 to 3. The acrylic polisher that can reserve a machining buffer space according to the invention has a base 11, a cutting blade set 21, a conveyor 31, and a stopping board 41.

The base 11 has two oppositely disposed sideboards 12 with a disposition surface 13 in between for the placement of an acrylic object 10. Each of the two sideboards 12 has a track 14 and a notch 15. The tracks 14 and notches 15 of the two sideboards 12 are opposite to each other, respectively. The notches 15 on the two sideboards 12 form an open space 16 on both sides of the disposition surface 13. One of the sideboards 12 has a control panel 17.

Figure 6:
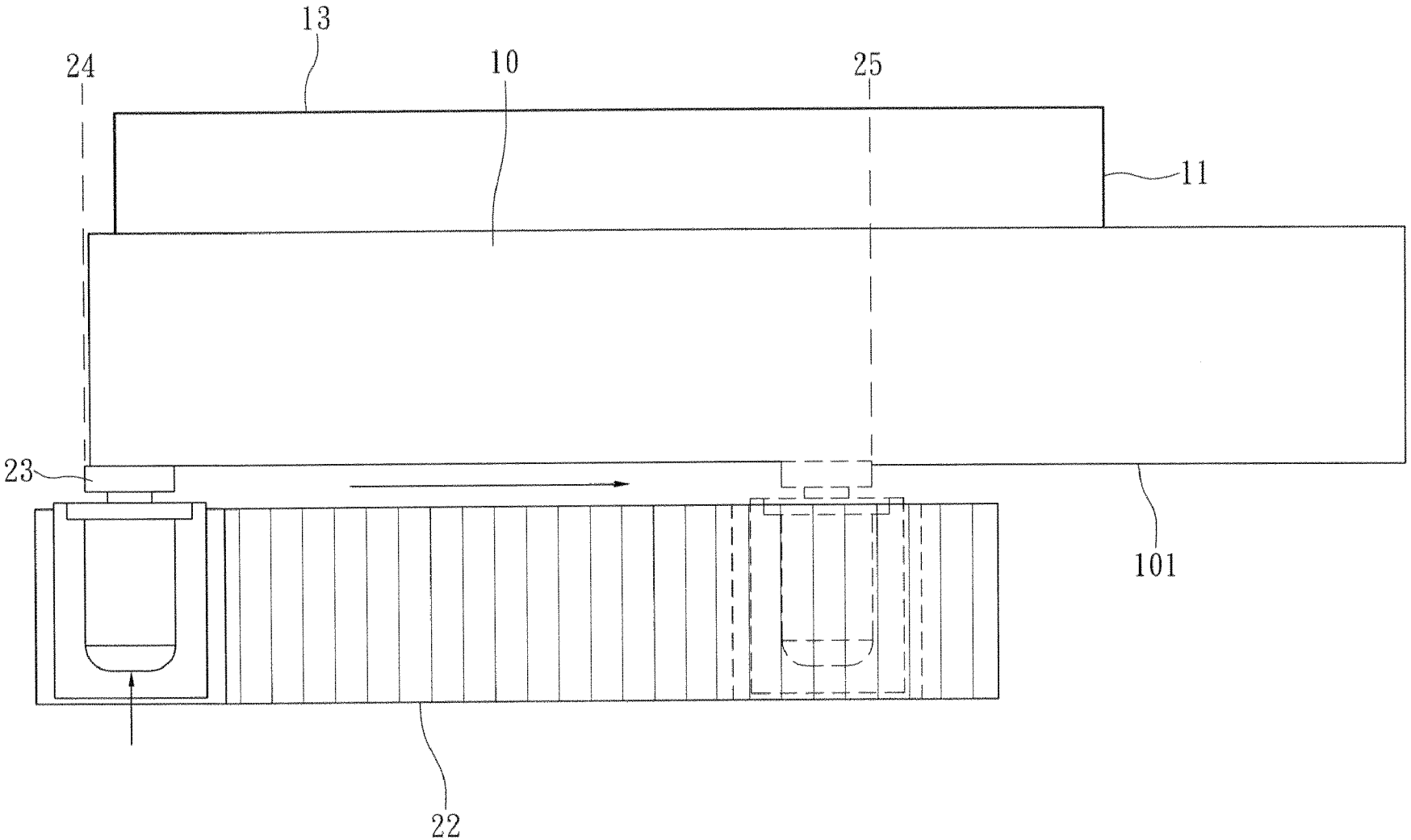
FIG. 6 shows the state of the invention in use, when the stopping board rises and the cutting blade performs a first-step cutting from the starting point to the ending point.

The cutting blade set 21 has a horizontal track 22 and a cutting blade 23. The horizontal track 22 is formed on the front side of the disposition surface 13 of the base 11. The cutting blade set 23 is disposed on the horizontal track 22 to perform a horizontal displacement toward the edge of the disposition surface 13 along the horizontal track 22. The cutting process is performed between a starting point 24 and an ending point 25, as shown in FIG. 6.

The conveyor 31 is disposed above the disposition surface 13, between the two sideboards 12. A driving device 32 (an air-pressured cylinder structure in this embodiment) is provided on the conveyor 31. One side of the conveyor 31 is further provided with several air-pressured cylinders 33, each of which is connected with a pressing element 331. The pressing elements 331 can press and position the acrylic object 10 disposed on the disposition surface 13.

The stopping board 41 is disposed in the conveyor 31 on the two sideboards 12. The stopping board 41 has roughly a U shape. Both sides are formed with a guiding track 42, respectively. The end surface of the stopping board 41 facing the acrylic object 10 has a stopping surface 43. The stopping board 41 is embedded by the guiding tracks 42 on its two sides in the tracks 14 of the two sideboards 12. The stopping board 41 is connected with the driving device 32, and driven by it to move up and clowns along the tracks 14 of the two sideboards 12 and relative to the disposition surface 13 of the base 11. When the stopping board 41 moves downward to the side of the disposition surface 13, a predetermined machining span 44 is formed between the stopping surface 43 of the stopping board 41 and the disposition surface 13 of the base 11. A protruding part 45 is formed on the stopping surface 43 near the starting point 24 of the cutting blade set 21. In this embodiment, the stopping surface 43 of the stopping board 41 is formed with an embedding groove 451, screwed with a protruding block 452. The protruding block 452 slightly protrudes from the stopping surface 43 to become the protruding part 45.

In practice, as shown in FIG. 2, the invention first uses the driving device 32 to move the stopping board 41 downward along the two tracks 14 to the side of the disposition surface 13 of the base 11. The machining span 44 is formed between the stopping surface 43 of the stopping board 41 and the disposition surface 13 at this moment. Therefore, the user only needs to directly put the acrylic object 10 on the disposition surface 13 of the base 11 and push it toward the stopping surface 43 of the stopping board 41. The stopping surface 43 of the stopping board 41 provides the surface of the acrylic object 10 to be polished with a guide and restricts the cutting depth on the acrylic object 10. Therefore, without additional measurements, the user can readily obtain a highly precise machining span 44. The invention can further fix the machining span 44 of the acrylic object 10 each time. Afterwards, as shown in FIG. 3, when the stopping board 41 rises, the air-pressured cylinders 33 lower the pressing elements 331 to press against the acrylic object 10 for fixing it. This make subsequent polishing of the acrylic object 10 by the cutting blade set more convenient.

Moreover, when the stopping board lowers to the side of the disposition surface 13 of the base 11, the guiding tracks 42 on both sides of the stopping board 41 are embedded in the tracks 14 of the two sideboards 12. Therefore, even if the user pushes the acrylic object 10 with a larger force so that there is a collision with the stopping surface 43 of the stopping board 41, the design of the guiding tracks 42 and the tracks 14 provides the stopping board 41 with a better supporting strength against the horizontal stress. It further ensures that the machining span 44 between the stopping surface 43 of the stopping board 41 and the disposition surface 13 is kept fixed, instead of having errors due to the collision of the acrylic object 10.

Figure 4:
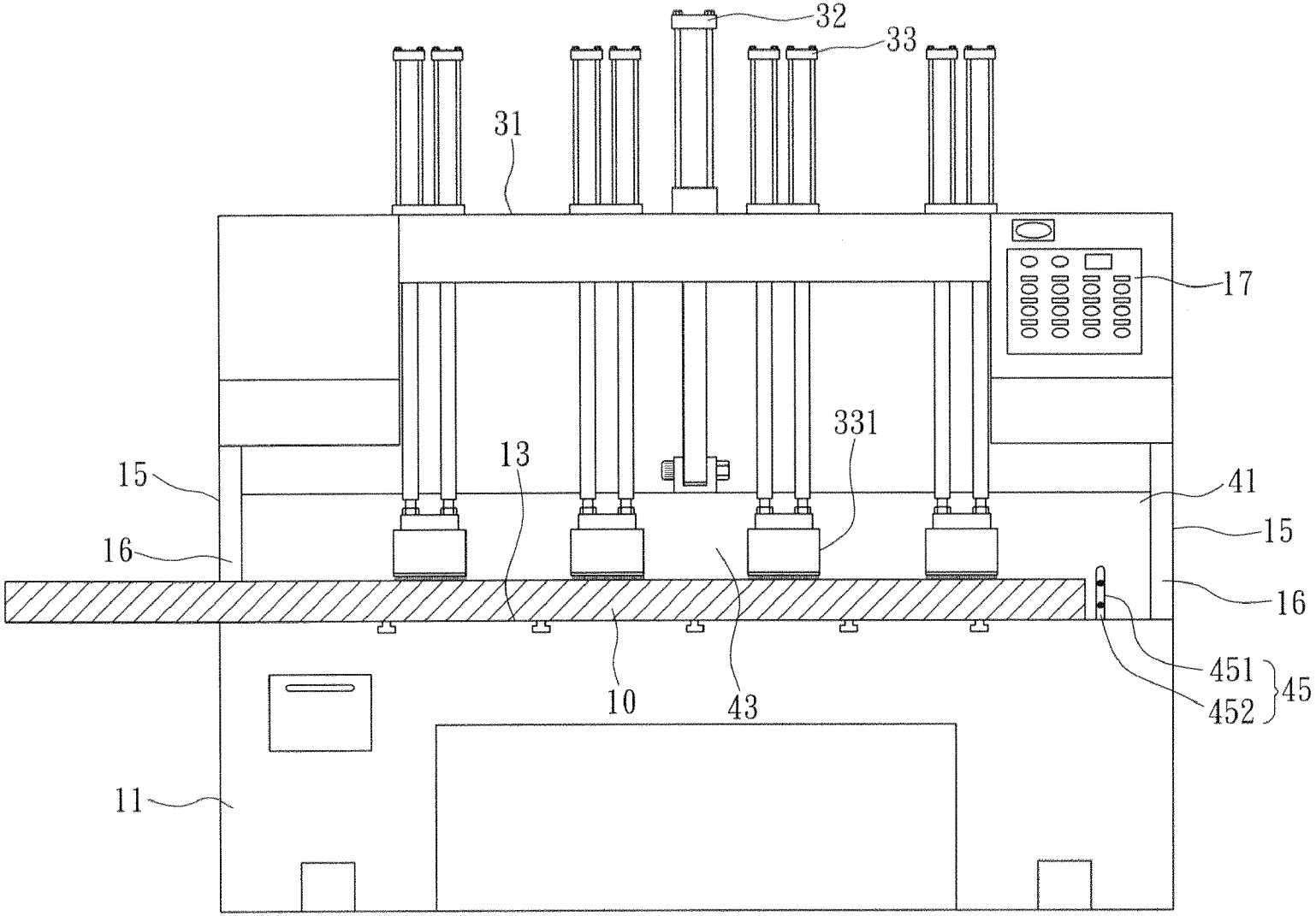
FIG. 4 shows the state of the invention in use, when a larger acrylic object is disposed on the base.
Figure 5:
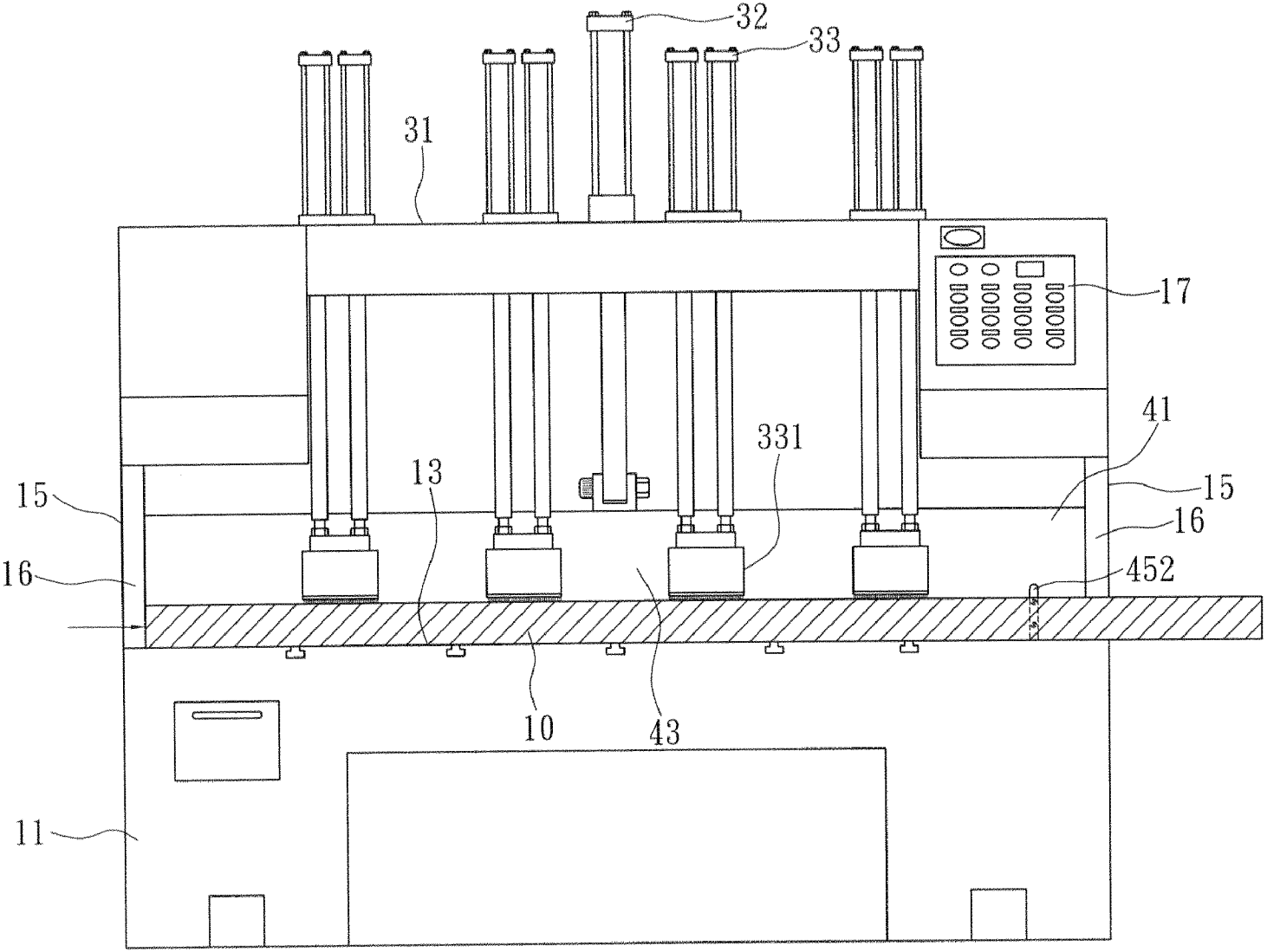
FIG. 5 shows the state of the invention in use, when adjusting the position of the larger acrylic object on the base.

As shown in FIG. 4, the invention uses the notches 15 on the two sideboards 12 to form an opening space on the left, right, and rear sides of the disposition surface 13 of the base 11. Therefore, even if the length of the acrylic object 10 is larger than the length of the disposition surface 13 of the base 11, the operator can conveniently dispose the acrylic object 10 on the disposition surface 13 through the opening space. As shown in FIG. 5, the operator only needs to adjust the position of the acrylic object 10 to complete the polishing job of the acrylic object 10 without additional cutting.

Figure 7:
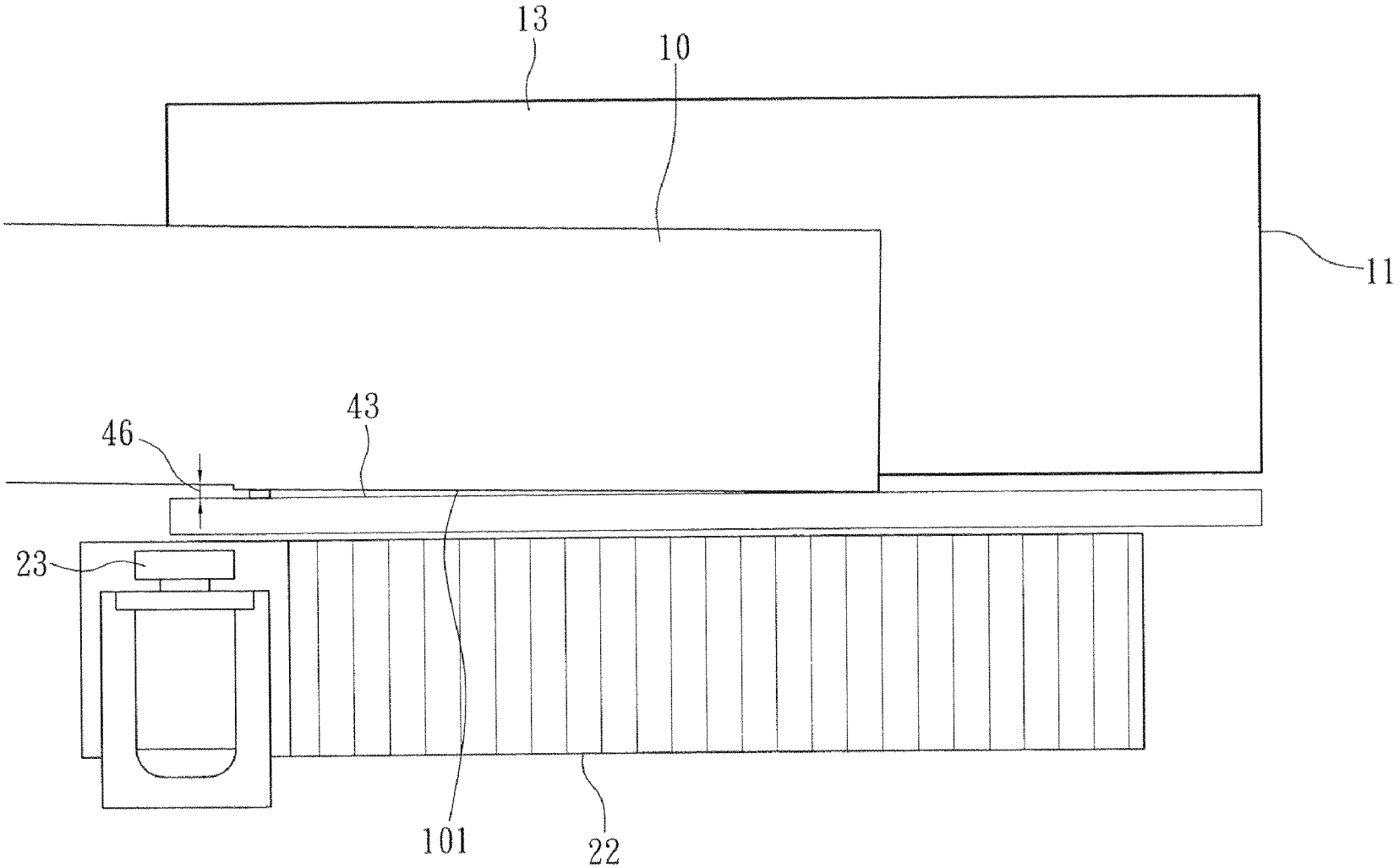
FIG. 7 shows the state of the invention in use, when the acrylic object is urged against the protruding part of the stopping surface to form a reserved machining buffer space.

Please refer to FIG. 6. When the invention polishes a larger acrylic object in several steps, the acrylic object 10 is directly disposed on the disposition surface 13 of the base 11. The user then pushes it toward the stopping surface 43 of the stopping board 41 for first polishing. After that, the operator adjusts the position of the acrylic object 10 so that the unpolished end surface 101 thereof is located in the cutting stroke of the cutting blade 23. Afterwards, the stopping board 41 is lowered to push the acrylic object 10 toward the stopping surface 43 of the stopping board 41. As shown in FIG. 7, the operator urges the acrylic object 10 against the protruding part 45 of the stopping surface 43. A reserved machining buffer space 46 formed between the acrylic object 10 and the stopping surface 43.

Figure 8:
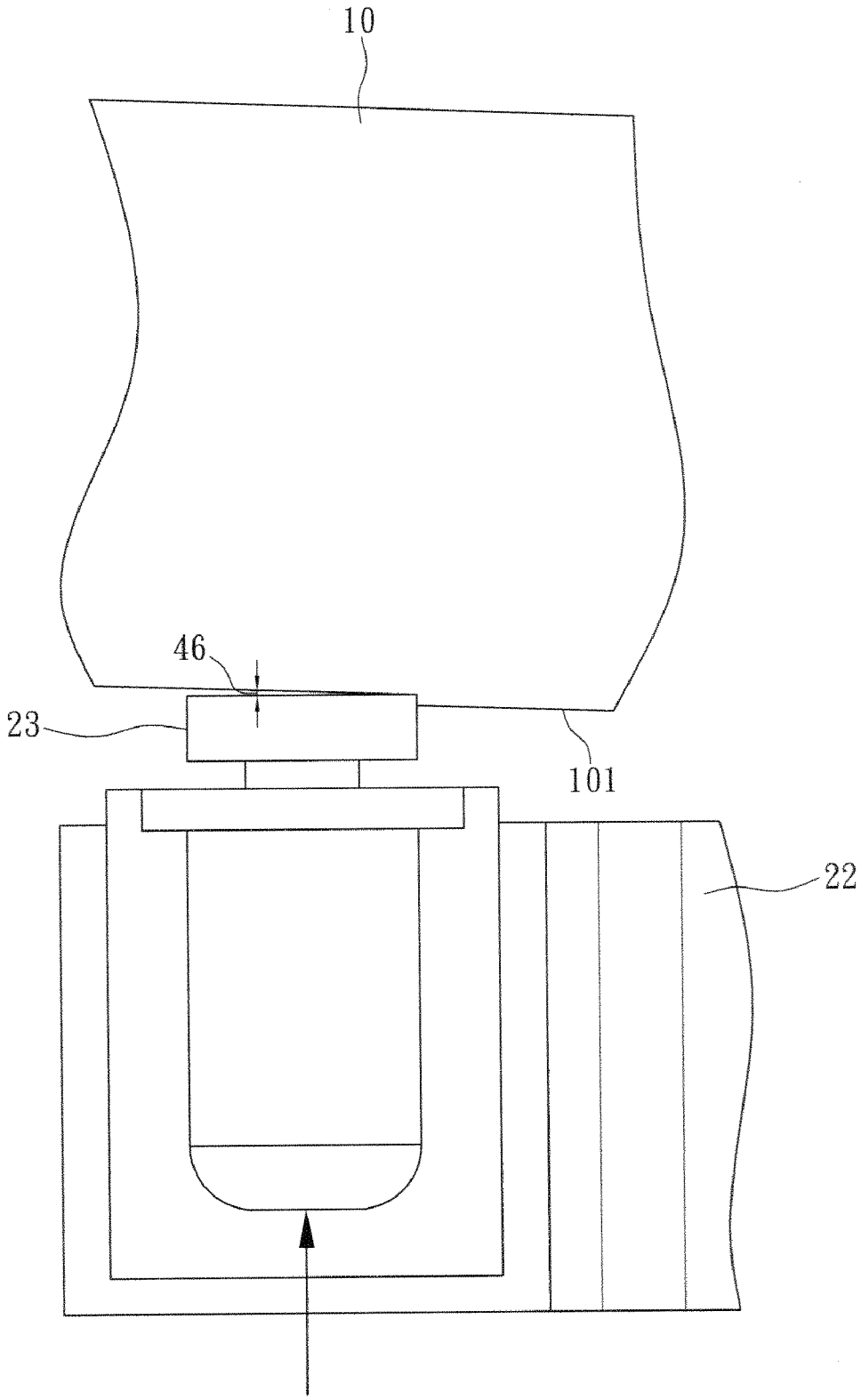
FIG. 8 is a local view showing the state of the invention in use, when the cutting blade performs a second-step cutting.
Figure 9:
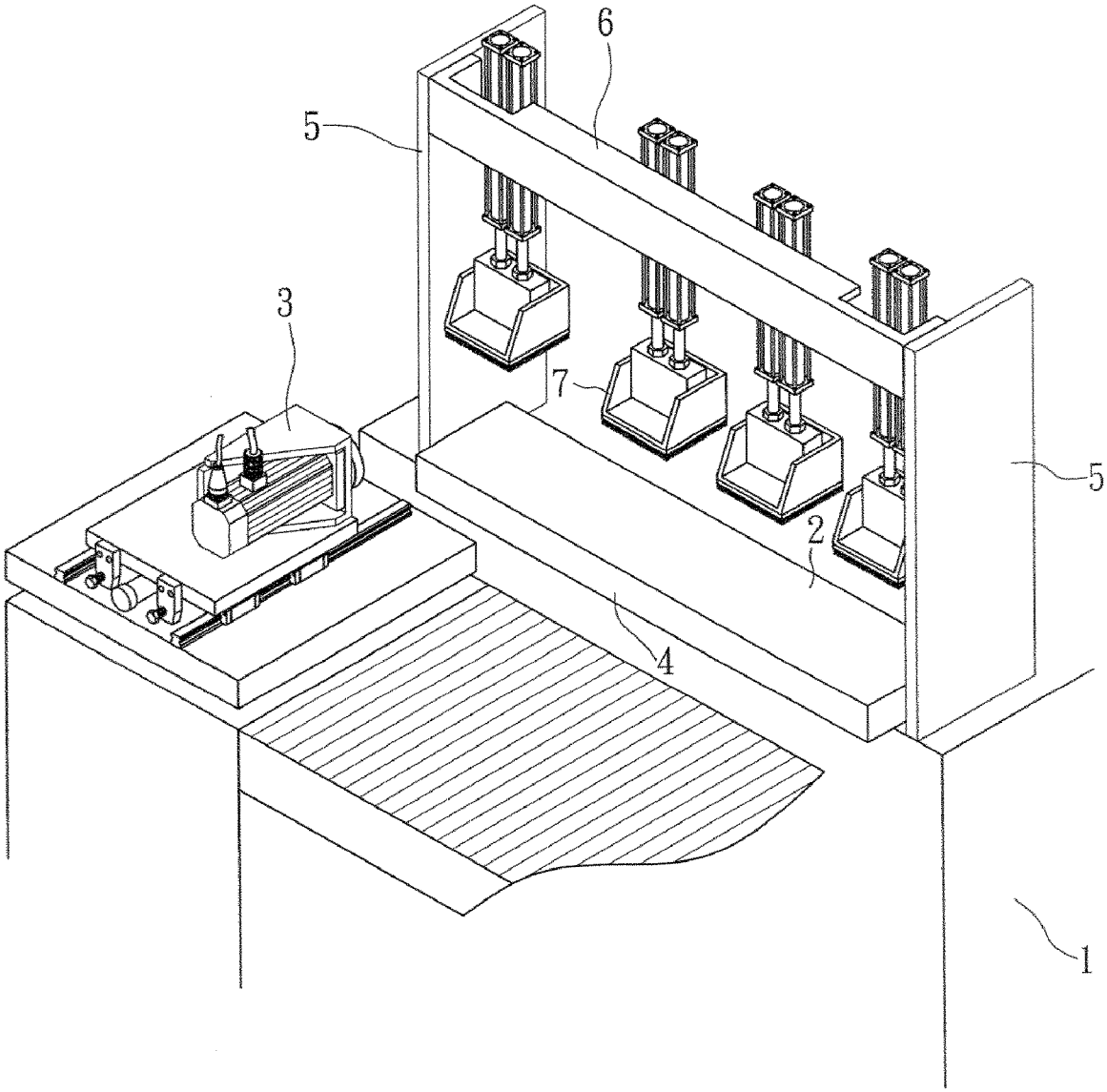
FIG. 9 PRIOR ART
FIG. 9 is a three-dimensional view of a conventional acrylic polisher.

As shown in FIG. 8, when the cutting blade 23 performs the second polishing, it does not directly touch the acrylic object 10 due to the machining buffer space 46. The machining buffer space 46 elongates the contact time between the cutting blade 23 and the acrylic object 10. The rotation speed of the cutting blade 23 can achieve a predetermined value, effectively avoiding scratches on the surface of the acrylic object 10 during the second polishing. The invention thus has very good surface yields.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An acrylic polisher comprising:

a base, which has two oppositely disposed sideboards with a disposition surface in between for the disposition of an acrylic object, each of the opposite end surfaces of the two sideboards having a track, and each of the two sideboards has a notch opposite to each other, forming an opening space on both sides of the disposition surface;

a cutting blade set, which is provided by the disposition surface of the base to perform a polishing stroke between a starting point and an ending point along the edge of the disposition surface;

a conveyor, which is disposed above the disposition surface and has a plurality of air-pressured cylinders on one side; each of which drives a pressing element to press against the disposition surface; and a stopping board, which is formed with a guiding track on its two sides respectively, and is embedded in the tracks of the two sideboards using the guiding tracks, and is driven by a driving device to move up and downs along the tracks and relative to the end surface of the disposition surface, and when the stopping board moves downward to the side of the disposition surface, the end surface of the stopping board facing the disposition surface becomes a stopping surface, and a predetermined machining span is formed between the stopping surface and the disposition surface.

2. The acrylic polisher of claim 1, herein one of the two sideboards has a control panel.

3. The acrylic polisher of claim 1, wherein the driving device is disposed on the conveyor to move the stopping board up and downs relative to the disposition surface.

4. The acrylic polisher of claim 1, wherein the stopping surface of the stopping board has a protruding part near the starting point of the cutting blade set so that a reserved buffer space forms between the acrylic object and the stopping surface when the acrylic object urges against the protruding part of the stopping surface.

5. The acrylic polisher of claim 4, wherein the stopping surface of the stopping board has an embedding groove with a protruding block screwed therein, the protruding block slightly protruding from the stopping surface to form the protruding part.

* * * * *